US008503693B2

(12) United States Patent
Yu et al.

(10) Patent No.: US 8,503,693 B2
(45) Date of Patent: Aug. 6, 2013

(54) BIOLOGY-INSPIRED MINIATURE SYSTEM AND METHOD FOR SENSING AND LOCALIZING ACOUSTIC SIGNALS

(75) Inventors: Miao Yu, Potomac, MD (US); Haijun Liu, Greenbelt, MD (US)

(73) Assignee: University of Maryland, College Park, MD (US)

( * ) Notice: Subject to any disclaimer, the term of this patent is extended or adjusted under 35 U.S.C. 154(b) by 326 days.

(21) Appl. No.: 13/046,238

(22) Filed: Mar. 11, 2011

(65) Prior Publication Data

US 2011/0222708 A1 Sep. 15, 2011

Related U.S. Application Data

(60) Provisional application No. 61/313,461, filed on Mar. 12, 2010.

(51) Int. Cl.
*H04R 3/00* (2006.01)

(52) U.S. Cl.
USPC ..... 381/92; 381/113; 381/114; 381/116; 381/173; 381/174; 381/175; 381/369; 381/355; 381/356; 381/357

(58) Field of Classification Search
USPC ..... 381/92, 113, 114, 116, 173–175, 381/369, 355–358
See application file for complete search history.

(56) References Cited

U.S. PATENT DOCUMENTS

2003/0228025 A1* 12/2003 Hannah ..... 381/113

OTHER PUBLICATIONS

Liu et al., "Fly-Ear Inspired Miniature Directional Microphones: Modeling and Exp. Study", IMECE2009 (2009).
Mason et al., "Hyperacute Directional Hearing in a Microscale Auditory System", Nature, 410(6829):686-690 (2001).
Miles at al., "Mechanically Coupled Ears for Directional Hearing in the Parasitoid Fly Ormia Orchracea", Journ. of the Acoustical Society of America, 98(6):3059-3070 (1995).
Robert et al., Directional Hearing by Mechanical Coupling in the Parasitoid Fly Ormia Ochracea, Journ. of Comp. Physiology A: Neuroethology, Sensory, Neural, and Behavioral Physiology, 179(1):29-44 (1996).

(Continued)

*Primary Examiner* — Vivian Chin
*Assistant Examiner* — Paul Kim
(74) *Attorney, Agent, or Firm* — Carter, DeLuca, Farrell & Schmidt, LLP

(57) ABSTRACT

A system and method for sensing acoustic sounds is provided having at least one directional sensor, each directional sensor including at least two compliant membranes for moving in reaction to an excitation acoustic signal and at least one compliant bridge. Each bridge is coupled to at least a respective first and second membrane of the at least two membranes for moving in response to movement of the membranes it is coupled to for causing movement of the first membrane to be related to movement of the second membrane when either of the first and second membranes moves in response to excitation by the excitation signal. The directional sensor is controllably rotated to locate a source of the excitation signal, including determining a turning angle based on a linear relationship between the directionality information and sound source position described in experimentally calibrated data.

28 Claims, 10 Drawing Sheets

OTHER PUBLICATIONS

Robert, "Innovative Biomechanics for Directional Hearing in Small Flies", Biol. Bull., 200:190-94 (Apr. 2001).
Touse et al., "Fabrication of a Microelectromechanical Directional Sound Sensor with Electronic Readout Using Comb Fingers", App Phys Ltrs, 96, 173701 (2010) (www.apl.aip.org/resource/1/applab/v96/i17/p173701_sl?isAuthorized=no).
Haykin et al., "The Cocktail Party Problem", Neural Computation, MA Inst. of Tech., 17, 1875-1902 (2005).
Cade, "Acoustically Orienting Parasitoids; Fly Phonotaxis to Cricket Song", Amer. Assoc. for Adv. of Sci., Science, New Series, vol. 190, No. 4221, pp. 1312-1313 (1975).
Robert et al., The Evolutionary Convergence of Hearing in a Parasitoid Fly and Its Cricket Host, Science, New Series, vol. 258, No. 5085, pp. 1135-1137 (1992).
Robert et al., "Tympanal Mechanics in the Parasitoid Fly Ormia Ochracea: Intertympanal Coupling During Mechanical Vibration", J Comp Physiol A, 183: 443-452 (1998).
Yovel et al., "Optimal Localization by Pointing Off Axis", Science, 327, 701 (2010).
Cui et al., "Optical Sensing in a Directional MEMS Microphone Inspired by the Ears of the Parasitoid Fly, Ormia Ochracea", MEMS 2006, Istanbul, Turkey, (Jan. 22-26, 2006).
Miles et al., "A Low-Noise Differential Microphone Inspired by the Ears of the Parasitoid Fly Ormia Ochracea", J. Acoust. Soc. Am., 125(4), pp. 2013-2026 (2009).
Yoo et al., "Fabrication of Biomimetic 3-D Structured Diaphragms", Sensors and Actuators A, 97-98, pp. 448-456 (2002).
Ono et al., "Design and Experiments of Bio-Mimicry Sounds Source Localization Sensor with Gimbal-Supported Circular Diaphragm", Transducers '03, IEEE, 12th Intl. Conf. on Solid State Sensors, Actuators and Microsystems (Jun. 2003).
Saito et al., "Micro Gimbal Diaphragm for Sound Source Localization with Mimicking Ormia Ochracea", SICE Aug. 5-7, 2002, Osaka, p. 2159 (2002).
Ando et al., "Novel Theoretical Design and Fabrication Test of Biomimicry Directional Microphone", Transducers 2009, Denver, CO, p. 1932 (Jun. 21-25, 2009).
Liu et al., "Biology-Inspired Acoustic Sensors for Sound Source Localization", Dept. of Mech. Eng., Univ of MD (2008).
Yu et al., "Biomimetic Optical Directional Microphone with Structurally Coupled Diaphragms", Amer. Inst. of Physics, 93, 243902-1 (2008).
Yu et al., "Acoustic Measurements Using a Fiber Optic Sensor System", Journ. of Intelligent Mat. Syst. and Struc., vol. 14, p. 409 (Jul. 2003).
Silverman et al., "A Two-Stage Algorithm for Determining Talker Location from Linear Microphone Array Data", Comp. Speech and Language, 6, pp. 129-152 (1992).
Hesselberg, "Sensors and Control Systems for Micro-Air Vehicles: Lessons From Flies", Lab of Beh. and Evol. Neurobiology, Smithsonian Trop. Res. Inst., Sensor Rvw., 29/2, pp. 120-126 (2009).
Brooks et al., "Effect of Directional Array Size on the Measurement of Airframe Noise Components", Amer. inst. of Aero. and Astro., NASA Langley Res Cntr., AIAA-99-1958 (1999).
Robert et al., "Tympanal Hearing in the Sarcophagid Parasitoid Fly Emblemasoma SP: The Biomechanics of Directional Hearing", J. of Exp. Bio., 202, pp. 1865-1876 (1999).

* cited by examiner

BIOLOGY-INSPIRED MINIATURE SYSTEM AND METHOD FOR SENSING AND LOCALIZING ACOUSTIC SIGNALS

PRIORITY

The present application claims priority under 35 U.S.C. §119(e) from a United States provisional application filed on Mar. 12, 2010 titled "Fly-Ear Inspired Miniature Acoustic Sensor System" and assigned U.S. Provisional Application Ser. No. 61/313,461, the entire contents of which are incorporated herein by reference.

STATEMENT REGARDING FEDERALLY SPONSORED RESEARCH

The invention described herein was made with government support under contract FA95500810042 awarded by the Air Force Office of Scientific Research (AFOSR) and contract CMMI0644914 awarded by the National Science Foundation (NSF). The government has certain rights in the invention described herein.

PUBLISHED WORKS INCORPORATED HEREIN BY REFERENCE

The following published two works describe inventive concepts attributed to the inventors of the present application, Miao Yu and Haijun Liu. The published works and their described inventive concepts are all incorporated herein by reference.

The present application is directed to subject matter described in L. J. Curran, H. Liu, D. Gee, B. Yang, and M. Yu, Microscale Implementation of a Bio-Inspired Acoustic Localization Device, Proceedings of SPIE, Vol. 7321, p. 73210B (2009), the entire contents of which are incorporated herein by reference.

The present application is also directed to subject matter described in H. J. Liu, M. Yu, L. Curran, and D. Gee, Fly-ear Inspired Miniature Directional Microphones: Modeling and Experimental Study, IMECE2009 (2009), the entire contents of which are incorporated herein by reference.

BACKGROUND

The present disclosure relates generally to a miniature system for sensing and localizing acoustic signals. In particular, the present disclosure relates to a miniature system for sensing and localizing acoustic signals inspired by the directional hearing of the fly *Ormia ochracea*.

The fly *Ormia ochracea* is a parasitoid insect that acoustically locates male field crickets by listening to their calling song at 5 kHz. The female fly, as part of her reproductive cycle, finds cricket hosts as a source of food for her larval offspring. With a separation of only 0.52 mm between auditory organs, less than 1/130 of the calling song sound wavelength, the best available interaural time difference (ITD) and interaural intensity difference (IID) are merely 1.5 μs and less than 1 dB, respectively. However, the fly has super-acute hearing for detecting sounds and localizing sound sources in the absence of visual and olfactory cues. See Robert, Innovative Biomechanics for Directional Hearing in Small Flies, *Biol. Bull,* 200: 190-94 (April 2001). The key to the fly's phenomenal directional hearing is that its auditory system includes a pair of tympanal membranes that are coupled by an intertympanal bridge, a cuticular structure that pivots about its middle. See R N Miles et al., Mechanically Coupled Ears For Directional Hearing in the Parasitoid Fly Ormia Ochracea, *Journal of the Acoustical Society of America,* 98(6): 3059-3070 (1995).]

As a result of the mechanical coupling, the fly's auditory system operates in a rocking mode in which the tympanal membranes move 180 degrees out of phase, and a bending mode in which the tympanal membranes move in phase. Owing to a suitable contribution from both modes, the fly ear can provide great amplification to minute directional cues from the acoustic inputs so that the magnitude of directional cues at the mechanical response level becomes detectable by the fly's neuron system. The mechanical interaural time difference (mITD) and mechanical interaural intensity difference (mIID) between the eardrum responses are as high as 50-60 μs and 12 dB, respectively.

During the localization process, the fly turns its head front (azimuth $\theta=0$) towards the sound source. The turning speed has been found to be a sigmoid function of azimuth, where the turning speed is a linear function of azimuth $\theta$ up to 20°-30°, and it is constant beyond this range. Here the azimuth is an angular measurement in a spherical coordinate system, which describes the angle between the midline (i.e., the vector starting from the midpoint between the centers of active portions of the two tympanal membranes and pointing in a direction that is perpendicular to the plane of the fly ear) of the fly ear and vector starting at the origin of the midline (i.e., the midpoint) and pointing to the sound source.

When the target is outside of the linear range, the fly performs laterization by only determining if the target is towards the left or right and makes a constant turn towards the target. Once the target is within the linear range, the fly performs localization by truly estimating the target position, and turning an appropriate amount of angle to let the midline of the ear point to the target. This laterization/localization scheme helps the fly to achieve an overall directional resolution as accurate as ±2° from the midline. See Mason et al., Hyperacute Directional Hearing in a Microscale Auditory System, *Nature,* 410 (6829):686-690 (2001).

SUMMARY

The present disclosure is directed to a sensing system having at least one directional sensor, each directional sensor including at least two compliant membranes for moving in reaction to an excitation acoustic signal and at least one compliant bridge. Each bridge is coupled to at least a respective first and second membrane of the at least two membranes for moving in response to movement of the membranes it is coupled to for causing movement of the first membrane to be related to movement of the second membrane when either of the first and second membranes moves in response to excitation by the excitation signal. The directional sensor is configured to provide dual optimality at a selected working frequency for achieving maximum directional sensitivity (DS) and minimum nonlinearity (NL), simultaneously, in the vicinity of a midline of between the at least two membranes.

The present disclosure is also directed to a method for sensing sound and determining directionality information about a location of a sound source of the sound. The method includes sensing an excitation acoustic signal by at least a first and second membrane which are sufficiently compliant to move in reaction to the excitation acoustic signal, vibrating by the at least first and second membranes in response to the sensing, vibrating by the at least first and second membranes in response to the sensing, and coupling the vibrations while pivoting about a fixed pivot area for causing vibrations of the first membrane to be related to vibrations of the second membrane when at least one of the first and second membranes senses the excitation sound signal. The method further includes sensing the vibrations of the first and second membranes, and comparing the sensed vibrations of the first and second membranes for determining directionality information about the location of a sound source of the excitation sound signal, including an angle that describes the location of the sound source relative to a reference.

The present disclosure is also directed to a directional sensor having a substrate that defines at least two cavities, first and second membranes and a compliant bridge. Each membrane has opposing top and bottom surfaces and is coupled to the substrate to cover a respective cavity of the at least two cavities and having at least a portion of its bottom surface exposed to the cavity. The first and second membranes are sufficiently compliant for moving in reaction to an excitation acoustic signal to move in reaction to the excitation signal, yet remain positioned to cover the associated cavity when reacting to the excitation signal. The bridge is coupled to the substrate at a pivot area positioned between the at least first and second membranes. The bridge is further coupled to the first and second membranes for moving in response to movement of either of the first and second membranes, including at least one of pivoting and bending about the pivot area, for causing movement of the first membrane to be related to movement of the second membrane when at least one of the first and second membranes moves in response to excitation by the excitation signal.

Other features of the presently disclosed directional sensor system will become apparent from the following detailed description, taken in conjunction with the accompanying drawings, which illustrate, by way of example, the presently disclosed directional sensor system.

BRIEF DESCRIPTION OF THE DRAWINGS

Various embodiments of the present disclosure will be described below with reference to the figures, wherein.

DETAILED DESCRIPTION

Mechanical Structure of the Directional Sensor

Figure 1:
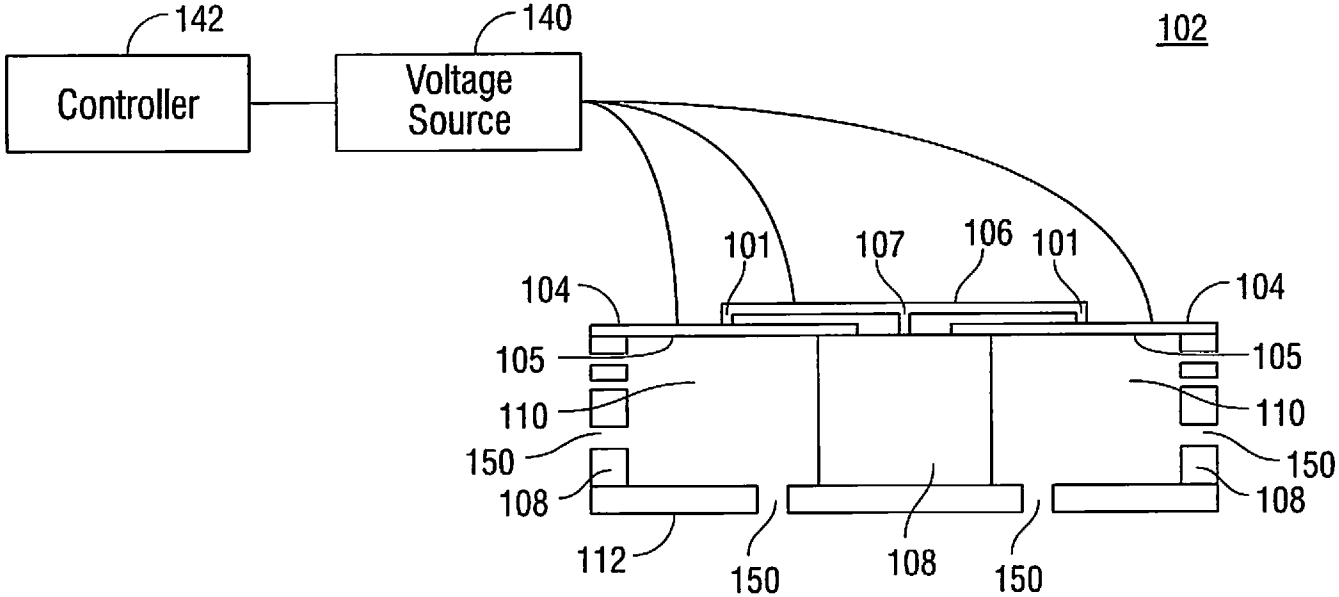
FIG. 1 is a cross-sectional view of an exemplary directional sensor in accordance with the present disclosure.

Referring now to the drawing figures, in which like reference numerals identify identical or corresponding elements, the acoustic sensor system and method in accordance with the present disclosure will now be described in detail. With initial reference to FIG. 1, an exemplary directional sensor in accordance with the present disclosure is illustrated and is designated generally as directional sensor 102.

Directional sensor 102 includes a pair of membranes 104 that are mechanically coupled to one another by a bridge 106. Each of the respective membranes 104 is coupled at its outer boundary to a substrate 108. In the current example, the entire outer boundary of each membrane 104 is securely attached to the substrate 108 via adhesion between materials. Other methods, such as by clamping or affixing the membrane 104 to the substrate 108 can also be used. [.

The substrate 108 is provided with a pair of cavities 110 that are situated below and fully covered by each of the membranes 104, respectively so that a bottom surface 105 of each membrane 104 is exposed in the associated cavity 108. Each membrane 104 has an active area which is the portion of the membrane 104 whose bottom surface is exposed to the associated cavity 110. The active area vibrates when it is exposed to an excitation acoustical signal. The boundary area of each membrane 104 that is coupled to the substrate 108 is a non-active area of the membrane 104, wherein a non-active area is an area that does not vibrate, e.g., is not displaced and does not rotate, when the membrane 104 is excited.

The membranes 104 are formed of a thin film that is compliant so that the membrane 104 reacts to the excitation acoustic signal by vibrating. The compliance of the membrane is a measure of its ability to respond to an applied vibrating force (the excitation acoustic signal), which is a reciprocal of the stiffness of the membrane 104. Exemplary thin film materials include silicon, silicon dioxide, silicon nitride, parylene, polyimide, and acrylics (Polymethyl-Methacrylate (PMMA)). The responses of the membranes 104 to a sound stimulus are tailored by selecting appropriate material properties (e.g. Young's modulus, density) and geometric dimensions (e.g. thickness, radius) for the membranes 104.

The bridge 106 couples to the each membrane 104 via a first coupling member 101 positioned in the active area of the membrane 104. First coupling member 101 allows the reaction force or moment to be transmitted between the membrane 104 and the bridge 106.

The bridge 106 is coupled to the substrate 108 via second coupling member 107 and is further supported by second coupling member 107. Second coupling member 107 allows the bridge 106 to both pivot and transmit a bending moment about a point or an area larger than a point at which the second coupling member 107 is coupled to the substrate 108. The second coupling member 107 is coupled to the bridge 106 at a middle area of the bridge 106 between its two end points. In the example shown, the second coupling member 107 is coupled to bridge 106 at a mid-point between the two ends of the bridge 106, and the first coupling members 101 are coupled to the bridge 106 at its two ends. The membranes 104 may extend to the location where the second coupling member 107 couples to the substrate The membranes 104 may even overlap one another. In any of these cases, the second coupling member 107 is still securely coupled to the bridge 107, with the membranes 104 intervening in-between.

As shown in FIG. 1, the first coupling members 101 and second coupling member 107 may be part of or attached to bridge 106 and extend from a bottom surface of the bridge 106. In the current example, first coupling members 101 are integral to the bridge 101, and second coupling member 107 is a rod that is coupled at opposing ends to the bridge 106 and the substrate 108, respectively. The disclosure is not limited to this configuration and other configurations and shapes of the membranes 104, the first coupling members 101, and the second coupling member 107 are contemplated.

The cavities 110 are enclosed in all directions. The enclosure is provided by substrate 108, backplate 112 which is located below substrate 108, and front and back plates that are not shown. The material forming substrate 108 and backplate 112 may include, for example, silicon dioxide, silicon nitride, parylene, polyimide, and acrylics. In one embodiment, as depicted in FIG. 1 the cavities 110 are enclosed separately, meaning there is one enclosed cavity for each membrane 104 and there is no communication, e.g., of gases, between the cavities. In another embodiment, shown in FIG. 2, some or all of the cavities 110 are interconnected, for example, forming a single common cavity or via at least one channel 202 so that there is communication, e.g., of gases, between the cavities 110.

In the embodiment shown in FIG. 1, the substrate 108 and/or backplate 112 or are provided with perforation holes 150 for increasing the damping of the directional sensor 102 and for compensating for variations in static pressure between the cavities 110 and the ambient environment. The perforation holes 150 are a series of small through holes provided on the backplate 112 or on the side walls of the substrate 108 that allow communication, e.g., of gases, between the cavities 110 to the ambient environment that surrounds the directional sensor system 100. These perforation holes 150 mainly mechanically affect the damping characteristics of the directional sensor system 100.

The material forming bridge 106 can be the same as or different from the material forming membrane 104. Some examples of material forming the bridge include silicon dioxide, silicon nitride, parylene, polyimide, and acrylics. Bridge 106 may be formed of multiple layers of different materials, wherein additional layers of material decrease the compliance (and thus increase the reciprocal stiffness) of the bridge 106. The coupling strength can be determined by using the ratio of the bridge stiffness and membrane stiffness. The coupling strength can thus be tuned by controlling the material properties (e.g. Young's modulus) and geometric dimensions (e.g. thickness, width, and length) of the membranes 104 and the bridge 106. [ The compliance of bridge 106 combined with its mechanical coupling to membranes 104 allows the bridge 106 to be excited by movement of the membranes 104 (and may additionally be excited, but less so by the excitation signal when bridge 106 has greater stiffness than membranes 104) causing the bridge 106 to vibrate and move by pivoting or bending about the second coupling member 107. The motion of the bridge 106 affects the vibrations of the two membranes 104 so that the vibrations of the two membranes 104 are related to one another and are therefore not independent.

The vibrations are related to one another in a variety of modes, including a rocking mode, in which the two membranes 104 while coupled by bridge 106 move substantially 180 degrees out of phase relative to one another, and a bending mode, in which the two membranes 104 while coupled to by bridge 106 move substantially in phase. The working frequency $f_w$ of the directional sensor 102 is the frequency of excitation signals which can most accurately be detected and located. The range of working frequency, range $f_w$, is the range of excitations signals that the directional sensor is expected to accurately operate in. $f_{rm}$ is the resonance frequency of the excitation signal that causes the membranes to operate in the rocking mode. $f_{bm}$ is the resonance frequency of the excitation signal that causes the membranes to operate in the bending mode. $f_{rm}$ and $f_{bm}$ are selected so that the predefined performance measures are optimized, including directional sensitivity and linearity. The damping factor of the directional sensor 102 influences the ratio of $f_w$ to each of $f_{bm}$ and $f_{rm}$.

$f_w$ and range $f_w$ are selected in accordance with the purpose of the directional sensor and the type of acoustic excitation signal and environment it is expected to work with accurately. It follows that $f_{rm}$, and $f_{bm}$ are selectable, based on $f_w$ and range $f_w$ as well as adjustable parameters of the directional sensor 102 that also affect the damping factors of the directional sensor 102.

One adjustable parameter, for example, is the stiffness of the membranes 104 and the bridge 106, which may be influenced by factors such as the thickness of the materials that the membranes 104 and bridge 106 are formed of, resistance to rotation about second coupling member 107, the diameter of the membranes 104, etc. For example, a thinner or larger membrane 104 will render a smaller stiffness of the membrane 104 as well as a smaller $f_{rm}$.

In one embodiment, a piezoelectric material (e.g., PZT) is applied, e.g., sputtered, on top of the bridge 106 or the membranes 104 to adjust their stiffness. Voltage may be applied to the sputtered piezoelectric material layer, which will generate strain which increases the stiffness of the bridge 106 or the membrane 104. FIG. 1 shows a voltage source 140 for applying voltage to piezo material layer applied to the membranes 104 and/of bridge 106. The amount of voltage applied by voltage source 140 is controlled by controller 142. The application of voltage will affect the stiffness of the membranes 104 or bridge 106 to which a piezoelectric material was applied. The stiffness change will affect $f_{rm}$ and $f_{bm}$. Accordingly, the directional sensor 102 can be tuned by adjusting the voltage to achieve a selected $f_{rm}$ and $f_{bm}$·$f_{rm}$ and $f_{bm}$ can be selected in accordance with a working frequency $f_w$ that the directional sensor is expected to detect and locate and the other existing damping factors. Accordingly, the voltage can be controlled to tune the directional sensor 102 to operate with a desired working frequency and other existing damping factors. Other means for adjusting the thickness and thickness of the membranes 104 or bridge 106 are envisioned, such as overlaying the membranes 104 or bridge 106 with incremental layers of a suitable material to achieve a selected thickness.

Another adjustable parameter is the depth of cavities 110 which can also affect the stiffness of the membranes 104; a smaller depth renders higher stiffness of membranes 104. It is envisioned that layers of material, such as silicon, may be added to the bottom of the cavities 110 to adjust the depth.

Still another adjustable parameter is the length of bridge 106, which is based on the distance between the centers of active portions of membranes 104. As the length of bridge 106 increases its stiffness decreased, thus lowering $f_{bm}$. It is envisioned that the bridge 106 may be fashioned to be capable of expanding or collapsing, such as by adding or removing extensions at its ends. Directional sensor may also be tuned by adjusting the position at which first coupling means 101 couples to the associated membrane 104, e.g., by moving the position off-center. This can be performed in conjunction with adjusting the length of bridge 106.

Directional sensor 102 may further be tuned by adjusting the distance between the centers of the active portions of membranes 104. This too can be performed in conjunction with adjusting the length of bridge 106. It is envisioned that the substrate 108 may be formed so that the distance between the cavities is adjustable, e.g., by fashioning the portion of the substrate located in-between the cavities 110 and the backplate 112 to be capable of expanding or collapsing. For example, that portion of the substrate and backplate 112 may each be formed of two or more segments that may be moved closer or further apart. Any gap could be filled with material, covered with a cover, or left open. The movement of the segments could be motorized, and the motorization could be controlled by controller 142. Accordingly, the directional sensor 102 can be tuned for use with different frequencies $f_w$, by selecting $f_{rm}$ and $f_{bm}$ by adjusting the parameters.

The structure of the directional sensor 102 shown in exemplary FIG. 1 is inspired by the structure of the acoustic apparatus of the *Ormia Ochracea* fly. In the current example, the membranes 104 are circular and flat. The cavities 110 are also circular and slightly smaller in diameter than the membranes 104. The membranes 104 are spaced from one another. The bridge 106 is rectangular. However, the disclosure is not limited to the configuration of the directional sensor 102 shown in FIG. 1. For example, the membranes 104 and cavities 110 may have a non-circular shape. The membranes 104 may not be flat, but may have a curvature. The membranes 104 may overlap one another and the bridge 106 may attach to the membranes 104 which may be attached to the substrate 108. Other configurations for coupling the pair of membranes 104 to one another via the bridge 106 and for coupling the bridge 106 to the substrate 108 are envisioned. The couplings shown and described may be direct or indirect with an intervening structure. The couplings shown and described may include using coupling means, such as an epoxy, a fastening device, or mating male and female parts.

Optical Detection Method

Figure 2:
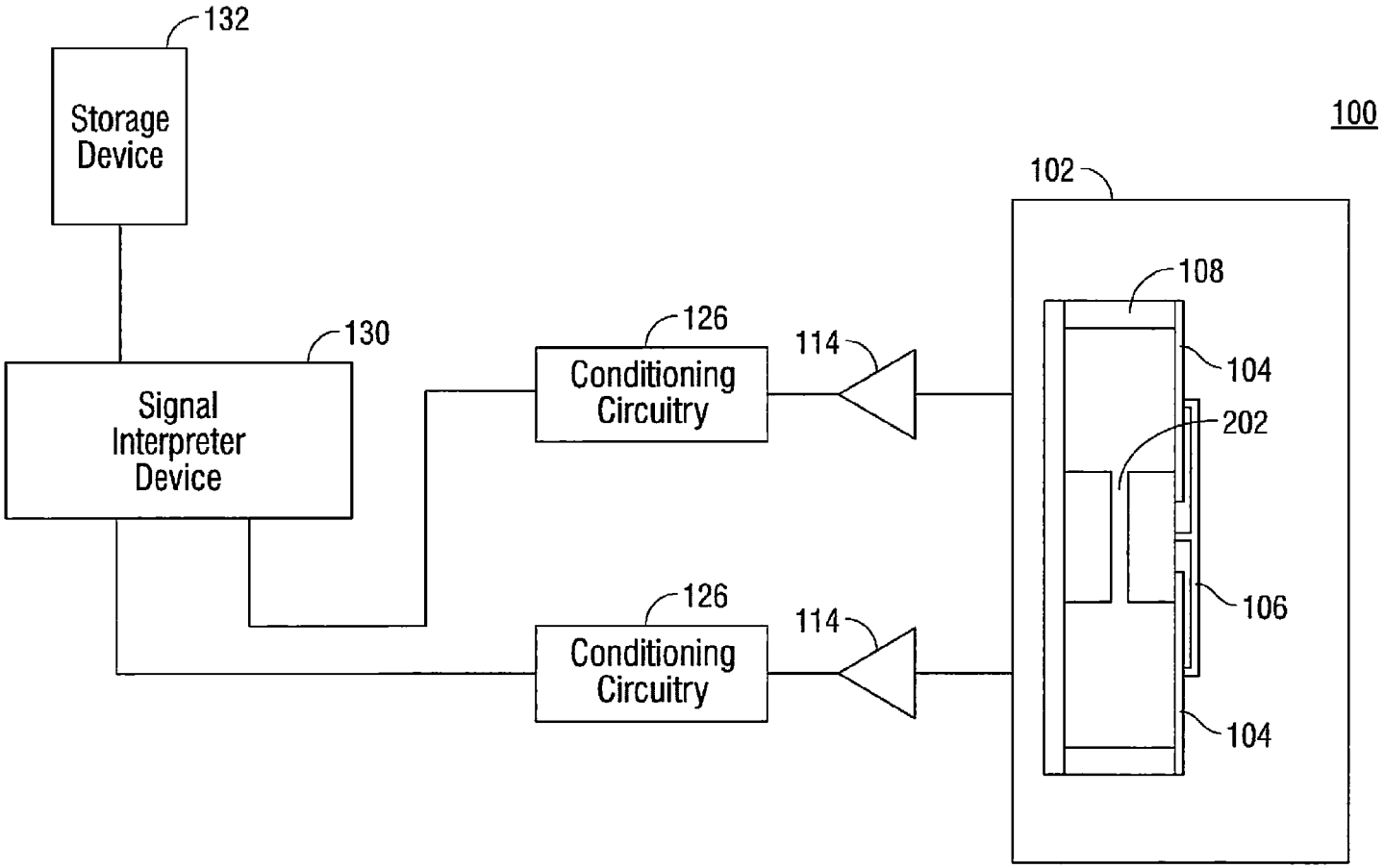
FIG. 2 is a block diagram of an exemplary acoustic sensing system in accordance with the present disclosure, with the directional sensor shown in cross-section.

An exemplary acoustic sensor system 100 is shown in FIG. 2. Transverse displacement of membranes 104 due to a sound stimulus is detected and encoded in a first energy form by encoder 114, e.g. where the first energy form indicates resistance change by the piezo-resistance effects, or phase change by an optical interferometer. Signal conditioning circuitry 126 converts the first energy form to at least one voltage signal. The signal(s) output by the signal conditioning circuitry 126 are provided to a signal interpreter device 130 that acquires and displays the membrane responses, calculates directional cues (e.g. mITD or mIID), and estimates the sound source location. Signal interpreter device 130 includes at least one computing device having a hardware processor (e.g., a microprocessor or CPU) and has access to at least one storage device 132.

Figure 3:
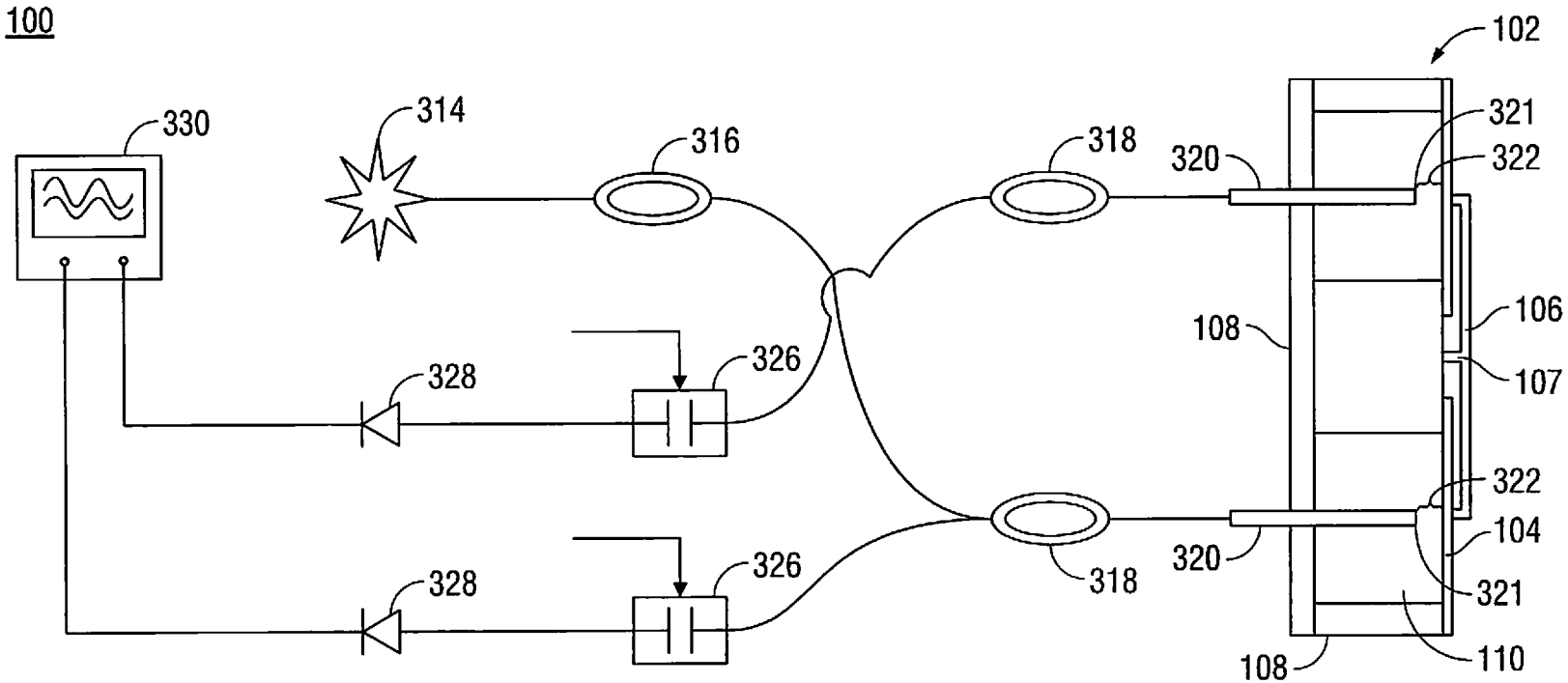
FIG. 3 is a schematic diagram of an exemplary embodiment of the acoustic sensing system in accordance with the present disclosure, with the directional sensor shown in cross-section.

FIG. 3 shows an exemplary embodiment of the acoustic sensor system 100 depicted in FIG. 2 that implements a low coherence fiber optic interferometer whose output is provided to an oscilloscope or a data acquisition (DAQ) board (not shown) for detecting and analyzing the motion of membranes 104. Light source 314 is provided. In the current example, light source 314 is a broadband source, which is a superluminescent light emitting diode (SLED). Light emitted by the light source 314 is sent via optical coupler 316, which in the current example is a 3 dB optical coupler, to two couplers 318 that direct the light energy to two optical fiber cables 320 which enter respective cavities 110.

A distal tip 321 of each of the optical fiber cables 320 is positioned within one of the cavities 110 so that it opposes the membrane 104 that is positioned above the associated cavity 110. The distal tip 321 and the opposing membrane 104 form a Fabry-Perot interferometer (FPI) 322, described in greater detail further below. Light reflected from each FPI 322 is coupled via couplers 318 to tunable filter 326 and then to photo detector 328. The output from the photo detector 328 is input to oscilloscope 330 or the DAQ board for display and/or data analysis.

Thus, FIG. 3 is an implementation of FIG. 2 using an optical detection method, wherein the encoder 114 includes optical fiber cables 320; signal conditioning circuitry 126 includes couplers 316 and 318, tunable filter 326, and photodetector 328; and signal interpreter device 130 includes oscilloscope 330 or a DAQ board (not shown). Other systems and methods envisioned for detecting the responses of membrane 104 may include piezo-resistive, capacitive, or piezo-electric technology.

Each of the optical fiber cables 320 are supported by the backplate 112 with a through-hole by which each of the optical fiber cables 320 is guided and fixed in position. Backplate 112 may be an integral part of the substrate 108 or may be a separate unit, such as a wafer, mechanically coupled to the substrate 108. The fiber optic cables 320 may be permanently fixed in the backplate 112, such as by using ultraviolet-cured epoxy glue. Alternatively, the fiber optic cables 320 may be adjustably fixed within the fiber guider 140, such as by a clamping mechanism, so that the length of the sensing cavity $L_s$, which is the distance between the distal tips 321 and the membranes 104, is adjustable, e.g., according to the coherence length of the light source 314

The light directed via each of the optical fiber cables 320 from light source 314 reflects off of the bottom surface 105 of the opposing membrane 104. The distal tip 321 reflects the reflected light back towards the opposing membrane 104. The light is reflected multiple times between the distal tip 321 and the bottom surface 105 of the opposing membrane 104. The FPI 322 is most effective when the bottom surface 105 of the membrane 104 and the distal tip 321 have smooth surfaces that are parallel to one another. As a result, multiple light beams are produced within the cavity 110 that can interfere with one another, resulting in multiple interfering light rays. The FPI 322 outputs a light signal via the fiber optical cable 320 to coupler 318. The light signal includes the phase information from the multiple interfering light rays, which is indicative of characteristics of the vibrations of the opposing membrane 104.

Each tunable filter 326 serves as a reference interferometer. It acts as a differential interferometer for assisting in noise cancellation. It has an adjustable optical path difference $L_r$, which can be obtained as $L_r=2nL$, where L is the cavity length of the reference Fabry Perot cavity and n is the refractive index of the cavity material. Here, n is adjustable by applying voltages to the tunable filter, which can thus change the $L_r$. The optical path difference $L_r$ can be adjusted to achieve maximum sensitivity of the acoustic sensor system 100. Exemplary Equation 1 describes optimization of the optical path difference (OPD), $L_s-L_r$ for m=0, ±1, ±2 . . . , wherein m is selectable in accordance with the application the acoustic sensor system 100 is used for. $L_s$ in Equation (1) is the optical path difference of the sensing interferometer, which can be obtained as $L_s=2nL_0$, where $L_0$ is the cavity length of the Fabry Perot cavity (which is the distance between the membrane 104 and the fiber tip 221) and n is the refractive index of the medium in the cavity. Here, for an air cavity, n=1 and thus $L_s$ is twice the cavity length of the Fabry Perot cavity.

$$L_s-L_r=(2m-1)\tfrac{1}{4}\lambda \tag{1}$$

In this exemplary embodiment, it is the differential phase between the sensing interferometer and the reference interferometer that is being measured. Due to the differentiation of the phase signal between the two interferometers, this technique has immunity to wavelength and power fluctuation induced noise, permits a short effective sensing cavity (only several μm), yields a high resolution (~$10^{-4}$ nm), and yields a large dynamic range (several tens of wavelength). Therefore, each FPI 322 provides a high performance, low noise optical detection mechanism that describes the movement of the associated membrane 104.

Sensor Design for Dual Optimality

The structure of the directional sensor 102, like that of the *Ormia ochracea* fly ear, provides dual optimality at a selected working frequency for achieving maximum directional sensitivity (DS) and minimum nonlinearity (NL) in the vicinity of the midline, simultaneously. The dual optimality can be achieved at a range close to the midline. Inspired by the fly ear, the range is chosen as, but not limited to, $-30°\leqq\theta\leqq30°$ in the current implementation. DS is defined as the derivative of mechanical interaural phase difference (mIPD) with respect to the incident angle θ, $$DS=\frac{\partial mIPD}{\partial\theta},$$

where θ is the incident azimuthal angle. θ is measured with reference to the midline for a one dimensional localization problem, and with reference to the plane which is perpendicular to the line connecting the centers of the active portion of the two membranes 104 and intersecting at the middle point of the connecting line for a 2-D or 3-D localization problem. mIPD is defined as the phase difference between the response of the two membranes 104. Using a lumped model and parameters for the fly ear reported in the literature (See R. Miles et al., Mechanically Coupled Ears for Directional Hearing in the Parasitoid Fly Ormia Ochracea, Journal of the Acoustical Society of America 98, 3059-3070 (1995)), mIPD and DS can be calculated for any azimuth θ or excitation frequency f.

Figure 4:
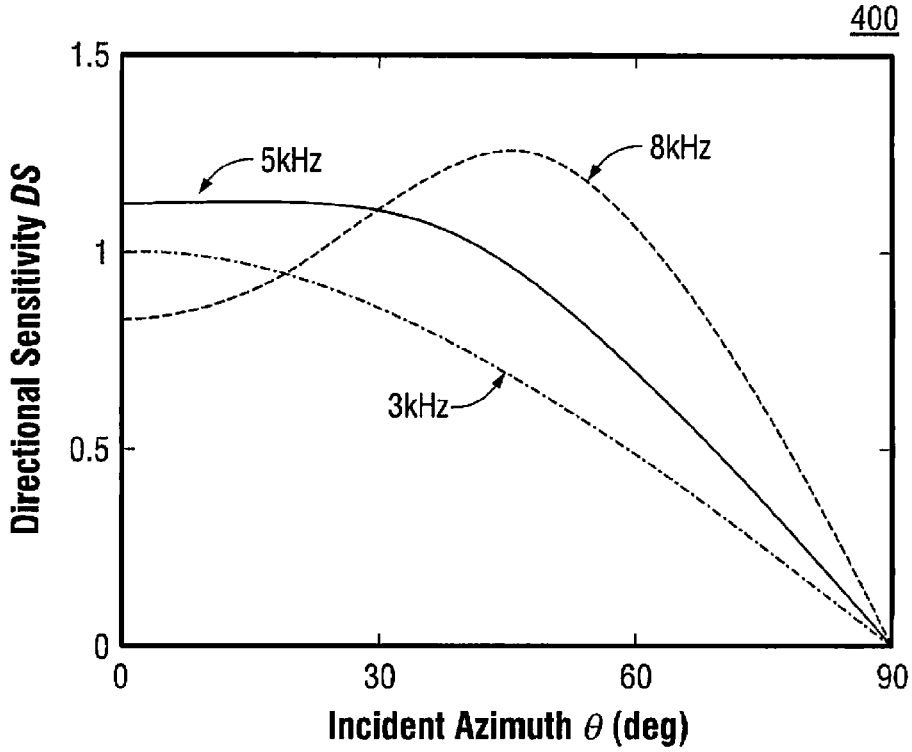
FIG. 4 is a graph including plots of directional sensitivity of the fly ear structure versus the angle of incidence θ of an excitation sound for working frequencies of 3 kHz, 5 kHz, and 8 kHz.
Figure 5:
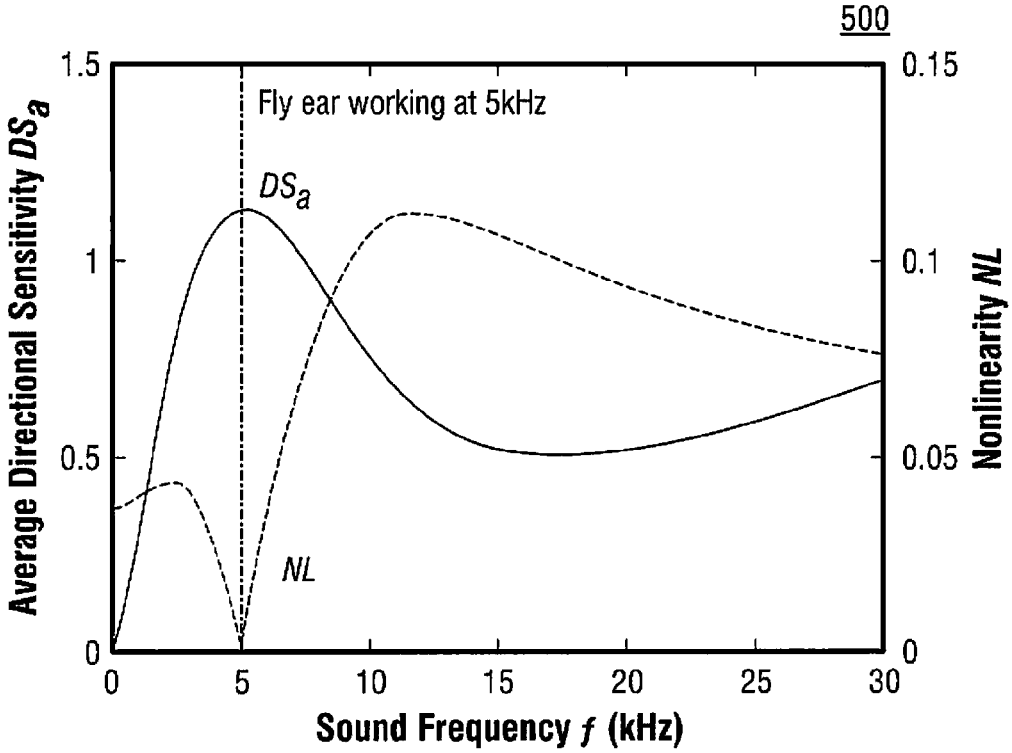
FIG. 5 is a graph including a plot of average directional sensitivity and nonlinearity of the fly ear structure for the incidental azimuthal angle θ for the range $0 \leqq \theta \leqq 30°$, discretized in increments of 1° over a range of sound frequencies.

With reference to FIG. 4 and FIG. 5, simultaneous optimization of DS and NL are demonstrated when the working frequency $f_w$ is 5 kHz, which is the working frequency of the fly ear. 5 kHz is the frequency of the calling sound of the fly's host crickets that the fly is expert at locating by sound and then devouring. In FIG. 4, graph 400 includes plots of DS versus θ for working frequencies of 3 kHz, 5 kHz, and 8 kHz. Two important features are illustrated by graph 400. First, DS is almost constant in the range $|\theta\theta|\leqq30$ degrees. Second, the value of DS is larger in this same range than that obtained at the other frequencies.

In FIG. 5, graph 500 shows a plot of average directional sensitivity ($DS_a$) and NL for the azimuth range $-30°\leqq\theta\leqq30°$, discretized in increments of 1° over a range of sound frequencies. See Equations 2 and 3 for the definition of $DS_a$ and NL for $-\theta_{max}\leqq\theta\leqq\theta_{max}$. Graph 500 shows that the maximum for DS and the minimum for NL occur at the frequency 5 kHz for $-30°\leqq\theta\leqq30°$, illustrating the fly's dual optimality at 5 kHz.

$$DS_a=\frac{\sum_{i=1}^{N}DS_i}{N} \tag{2}$$

$$NL=\frac{\sum_{i=1}^{N}|DS_i/DS_a-1|}{N} \tag{3}$$

To achieve such a dual optimality characteristic, suitable contributions from both the rocking and the bending modes are necessary. This is determined by the resonance ration η, where $\eta=f_{bm}/f_{rm}$, for $f_{bm}$=the bending mode natural frequency, and $f_{rm}$=the rocking mode natural frequency. In the fly ear studies have shown that η=4.36. It is noted that the resonance ratio η, also described as the coupling strength, is related to the stiffness ratio $\sigma=k_3/k_1$, where $k_3$ is the stiffness of bridge 106 and $k_1$ is the stiffness of membranes 104. The relationship between the η and σ is defined as $\eta^2=1+2\sigma$, which is the key non-dimensional structural parameter that determines how strongly the two fly ear membranes are coupled.

Figure 5A:
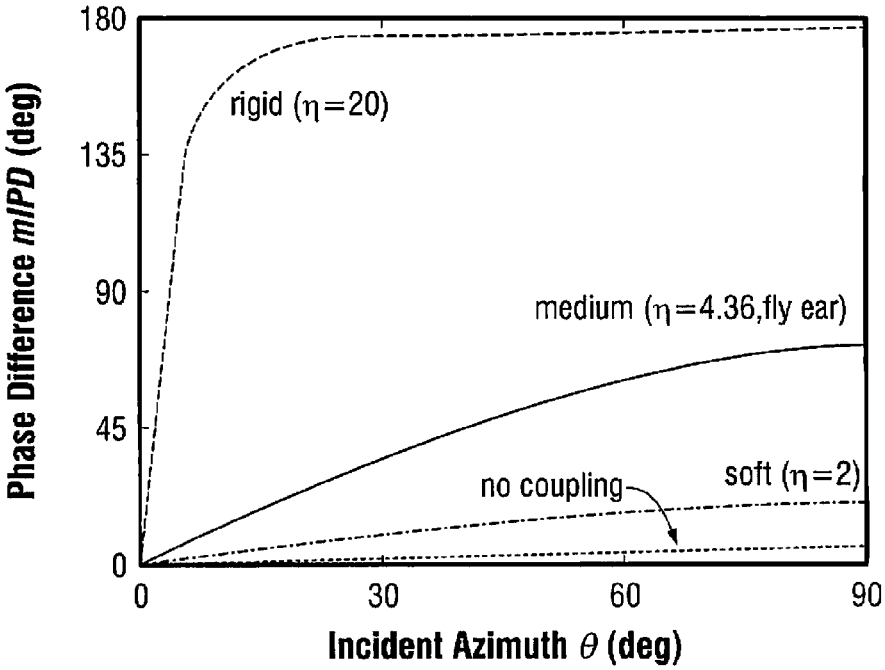
FIG. 5A is graph showing plots of mechanical phase difference mIPD for the fly ear structure versus incidental azimuth θ for a variety of resonance ratios η.

As shown in FIG. 5A, given the same separation to wavelength ratio (defined further below with respect to the description of FIG. 6) as the fly ear, if the coupling is weak (e.g., η=2), the amplification of phase difference is not significant, i.e., DS is too small to achieve the maximal value. On the other hand, when the coupling is rigid (e.g., η=20), even though the mIPD can be significantly amplified, it saturates at 180° when θ is slightly off the midline, and thus, it is not possible to distinguish the azimuths and the minimum NL is not achievable. Only when the resonance ratio η is "medium" (η=4.36), the fly ear can achieve a balance between DS and NL, and thus, the dual optimality can be achieved at its working frequency. Without coupling, when η=0, there is virtually no increase in mIPD.

Figure 6:
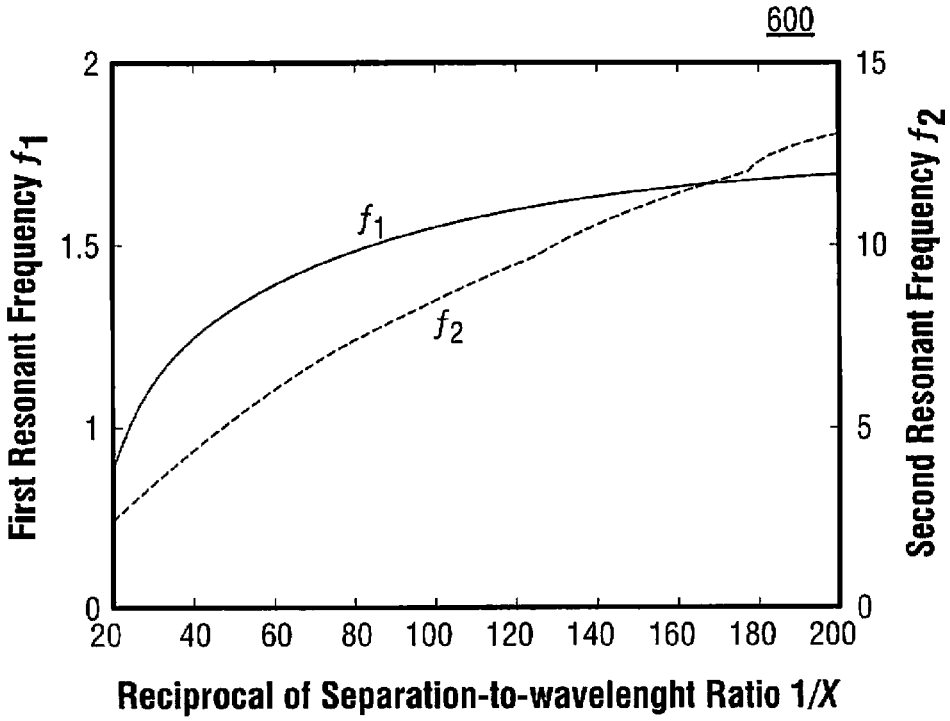
FIG. 6 is a graph including a plot of two resonance frequencies, $f_{rm}$ and $f_{bm}$, plotted versus $1/\chi$ generated based on modal analysis of the directional sensor shown in FIG. 1, where χ is separation (d)/wavelength of the sound source ($\lambda_{ss}$), and separation d is the distance between the centers (or an equivalent reference point) of membranes of the directional sensor.

The dual-optimality can be extended to other applications, including different device sizes or working sound frequencies, not limited to the fly ear's specific size or working sound frequency 5 kHz. Assuming the damping factors are same as the fly ear (0.89 for the rocking mode and 1.23 for the bending mode), an optimization can be conducted to find the combinations of parameters to achieve a similar dual-optimality as the fly ear. FIG. 6 shows the two resonance frequencies, $f_{rm}$ and $f_{bm}$, plotted versus 1/χ, where χ is the separation-to-wavelength ratio d/λ, where $\lambda_{ss}$ is the wavelength of the sound source and d is the distance between the centers (or an equivalent reference point) of active portions of membranes 104. The plot can then be used to select $f_{rm}$ and $f_{bm}$ for a directional sensor 102 having a selected separation d to locate a source with a sound frequency equal to $f_{ss}$.

Generation of FIG. 6 includes obtaining the average directional sensitivity $DS_a$ and nonlinearity NL as functions of normalized frequency $f/f_{rm}$ for any point in the design space of $f_{rm}/f_w$ and $f_{bm}/f_w$ for a given separation-to-wavelength $\chi$. Then the combinations of $f_{rm}/f_w$ and $f_{bm}/f_w$ that has maximum $DS_a$ and minimum NL at the frequency $f_w/f_{rm}$ are found and used to generate FIG. 6.

Thus, the resonance ratio $\eta$ can be determined based on the selected working frequency $f_w$ and the device size by using the dual optimality design curves shown in FIG. 6. Furthermore, the desired $f_w$ and desired $f_{rm}$ and $f_{bm}$ can be used to fashion the design of the mechanical structures (e.g., geometric dimensions and material selections) of the directional sensor 102. Using the selections made, the directional sensor 102 can work satisfactorily at a selected narrow bandwidth centered at the frequency $f_w$.

Table 1 shows parameters for three different directional sensors A, B, and the fly's ear, each having a different separation-to-wavelength ratio, $\chi$. As shown in Table 1, $f_{rm}$ and $f_{bm}$ are selected for each design using graph 600 shown in FIG. 6.

TABLE 1

Parameters of three optimal designs

| | Separation d (mm) | Working frequency $f_w$ (kHz) | Rocking mode natural frequency $f_{rm}$ (kHz) | Bending mode natural frequency $f_{bm}$ (kHz) |
|---|---|---|---|---|
| A | 1.2 | 14.2 | 13.0 | 35.3 |
| Fly | 1.2 | 5.0 | 7.1 | 31.0 |
| B | 1.2 | 2.8 | 4.4 | 24.0 |

Figure 7:
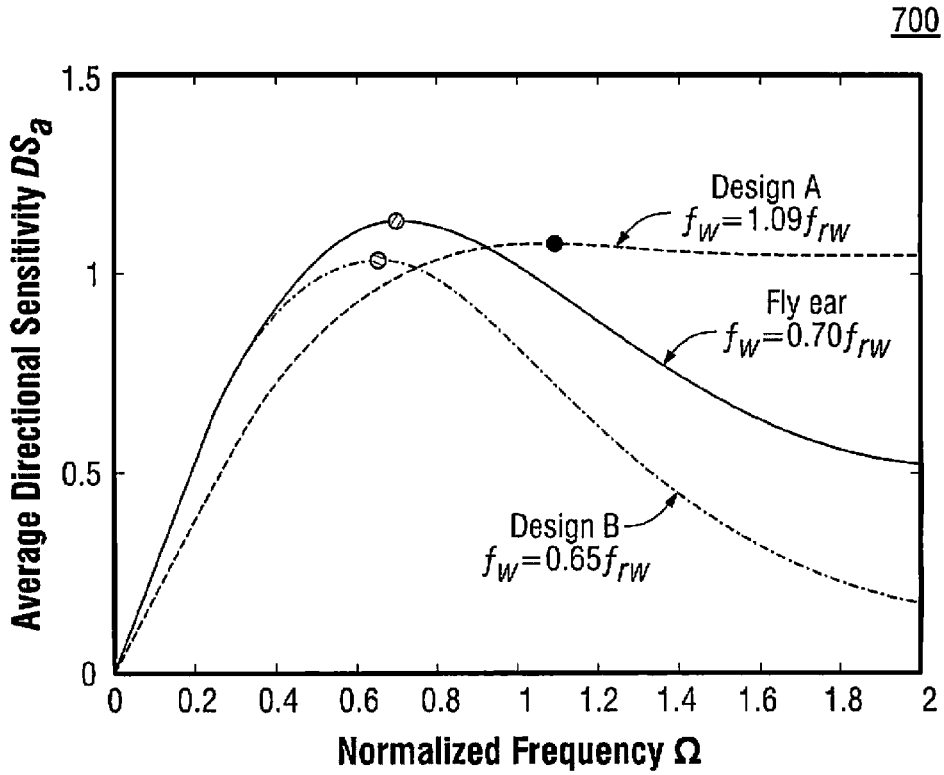
FIG. 7 is a graph including a plot of $DS_a$ as a function of Ω, wherein Ω is the normalized frequency $f_{ss}/f_{rm}$.
Figure 8:
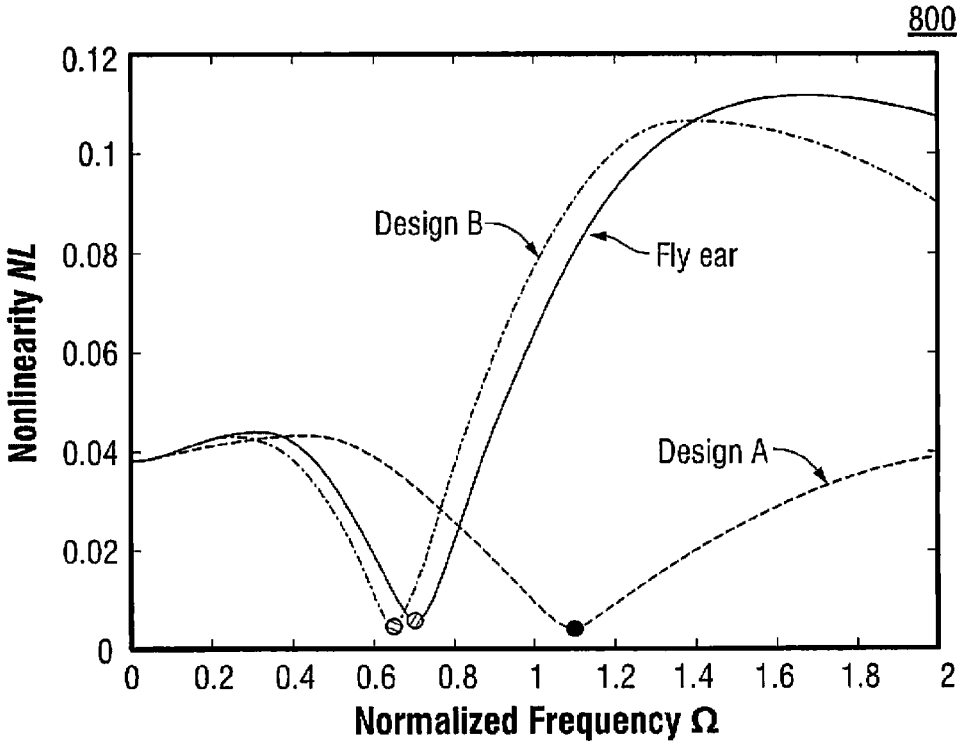
FIG. 8 is a graph including a plot of NL as a function of Ω.

With reference to FIGS. 7 and 8, graphs 700 and 800 show $DS_a$ and NL as a function of $\Omega$, wherein $\Omega$ is the normalized frequency $f_{ss}/f_{rm}$. FIGS. 7 and 8 show that all three directional sensors A, B, and the fly's ear, have maximum $DS_a$ and minimum NL at their corresponding working frequencies.

Determining Directionality

The processor of signal interpreter device 130 executes a first software module for comparing the output signals that correspond to each of the membranes 104 to generate directionality information (also referred to as directionality cues) about the location and direction of the sound source relative to the directional sensor 102. Directionality information may be generated, for example, by analyzing differences in intensity, timing, and phase of the output signals from the two membranes 104. For example, the ratio of mean-square averages gives the mechanical interaural intensity difference (mIID). Time or phase delay gives mechanical interaural time difference (mITD) or mechanical interaural phase difference (mIPD). The directional cues at various frequencies and azimuth are calibrated experimentally and the calibrated results are used to determine the azimuth $\theta$ related to sound source localization. The processor of signal interpreter device 130 executes the first software module for accessing experimental calibration data stored on the storage device 132, using the calibration data to determine the relationship of the mITD and mIID as a function of azimuth $\theta$. and using it as a transfer function to determine the azimuth $\theta$.

Experimental Results

Figure 9:
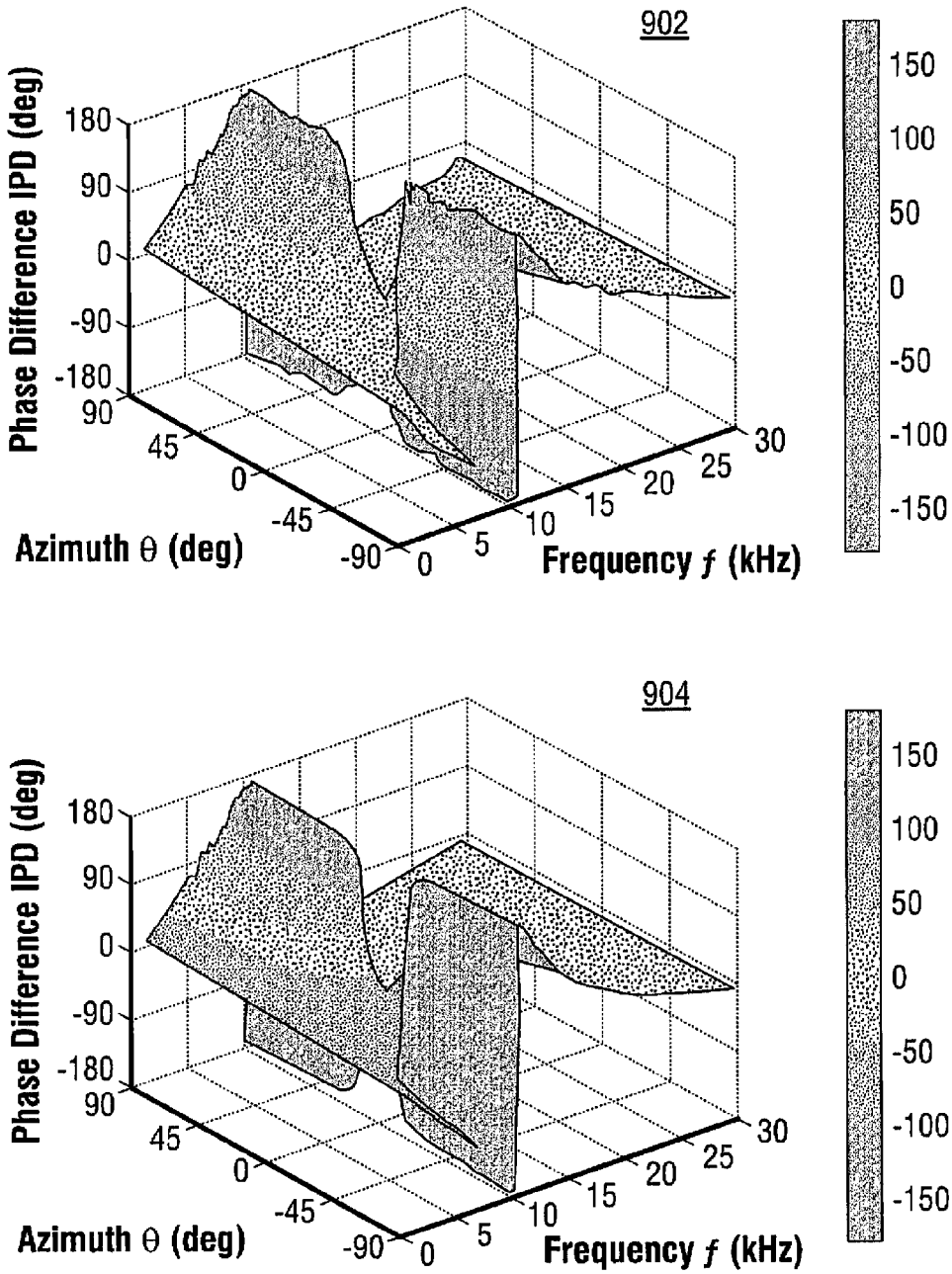
FIG. 9 is a graph including a plot 902 of mIPD simulation results and a plot 904 of mIPD experimental results using a prototype of the directional sensor at various frequencies for different azimuths θ.

FIG. 9 shows a plot 902 of mIPD simulation results and a plot 904 of mIPD experimental results using a prototype of the directional sensor 102 at various frequencies for different azimuths $\theta$. The initial phase difference can be assumed to be $IPD_0=d\sin(\theta)/\lambda$, where $\lambda$ is the wavelength of the excitation signal. At a sound frequency of $f_{ss}$=10 kHz and azimuth $\theta$ of 90°, $IPD_0$=13°. As shown in FIG. 9, phase difference is greatly amplified for a wide range of frequency $f_{ss}$. It can also be observed in FIG. 9 that mIPD experiences a sign change around the rocking mode resonance $f_{rm}$. This may be solved by altering the mechanical structure of the prototype sensor to provide additional damping.

Figure 10:
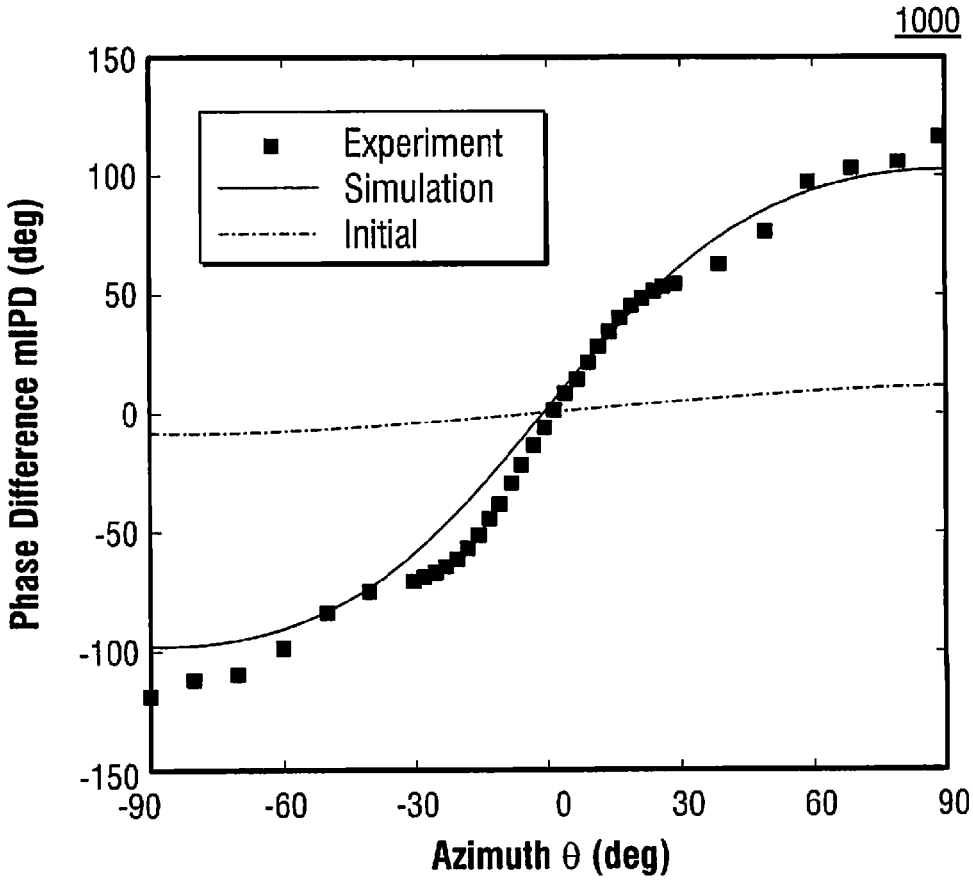
FIG. 10 is a graph including a plot 1200 of experimental data for the phase difference between two membrane responses of the directional sensor as a function of θ at 7 kHz.

FIG. 10 shows a plot 1200 of experimental data for mIPD as a function of $\theta$ at 7kHz. As previously stated, the variation of mIPD with respect to $\theta$ is the directional sensitivity (DS). FIG. 10 shows that mIPD, unlike mIID, changes monotonically as a function of $\theta$. Moreover, DS is maximum in the vicinity of the midline ($\theta$=0) and decreases to zero at the two extreme positions ($\theta=\pm 90°$). By curve fitting the experimental data for $-20° \leqq \theta \leqq 20°$, DS is found to be 2.77 deg/deg, which is 17.3 times of the initial directional sensitivity (0.16 deg/deg) at $\theta$=0. This high DS is equivalent to the DS obtained from a traditional microphone pair in which membrane pairs are spaced 1.25 mm×17.3=21.6 mm apart, which is 20 times larger in terms of membrane separation relative to the prototype of the directional sensor 102.

Method and System for Using the Directional Sensor for Sound Localization

Figure 11:
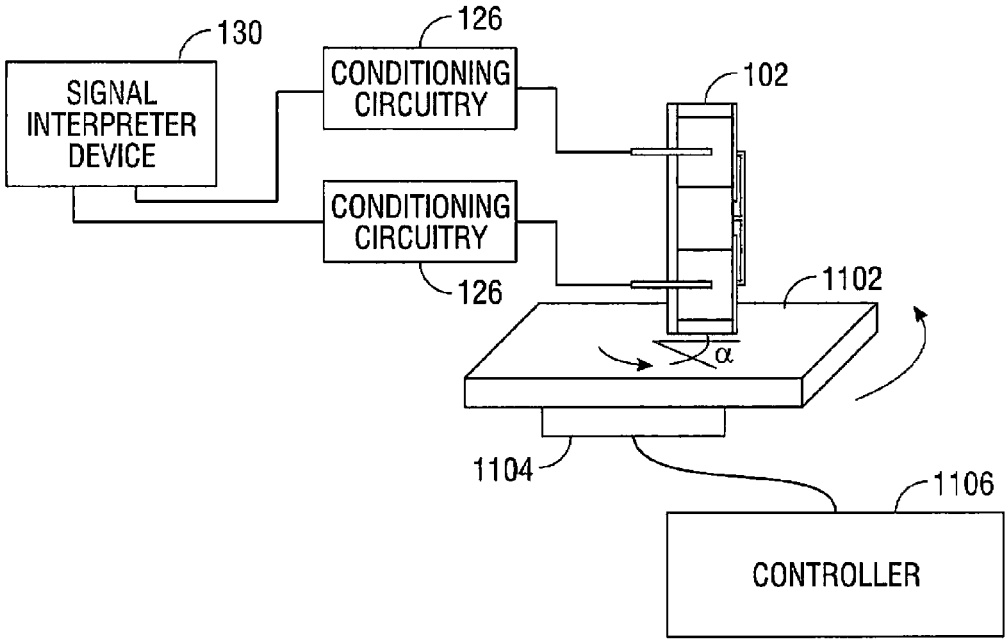
FIG. 11 is a block diagram of the directional sensor mounted on a rotational platform having a means for rotating the platform that is controlled by a controller.

With reference to FIG. 11, the directional sensor 102 may be mounted on a rotational platform 1102 (e.g., a stage or base) having a means for rotating 1104 (e.g., a motor, gears, etc.) for rotating platform 1102 that is controlled by controller 1106. The controller 1106 is a computing device, such as a microprocessor, a laptop computer, a desktop computer, a handheld computing device, such as a cell phone or PDA, etc. The controller 1106, controller 142, and/or signal interpreter 130 may be combined into a signal structural or functional unit, or may remain structurally and/or functionally separate.

The controller 1106 controls motor 1104 to rotate platform 1102 about a turning angle $\alpha$ to implement the laterization/localization method that the *Ormia Ochracea* fly uses. In the vicinity of midline, azimuth range of $|\theta| \leqq 20°$-30°, the controller 1106 controls rotation of the platform 1102 so that the turning angle $\alpha$ is a linear function of the detected azimuth $\theta$. However, outside of the linear range, the controller 1106 controls rotation of the platform 1102 so that the directional sensor 102 is turned by a constant turning angle $\alpha$ to approach the sound source azimuth, i.e., the turning angle $\alpha$ is incremented by a selected constant amount.

More specifically, the processing device of signal interpreter 130 receives two signals output by the two respective photo detectors 128. The processor of signal interpreter device 130 executes first software module for using the received signals output by photo detectors 128 to calculate the phase difference mIPD. The processor of signal interpreter device 130 executes a second software module for accessing experimentally derived Linear Determination Data, which includes calibrated data for various frequencies that correlates directionality information to a relative position of a sound source as the relative position changes, e.g., due to rotation of the sensor generating the directionality information. In the current example the directionality information is mIPD, but it is not limited thereto. The Linear Determination Data indicates a linear range which is range of values of mIPD for which mIPD and the relative position of the sound source have a linear relationship. The Linear Determination Data is stored by storage device 132 shown in FIG. 2 that is accessible by the signal interpreter 130. The processor of the signal interpreter 130 executes the second software module for using the Linear Determination Data to determine if the mIPD is in the linear range or not.

Based on the experiment and simulation investigation, phase difference mIPD is a monotonically increasing or decreasing function of azimuth $\theta$ in the range of $-90° \leqq \theta \leqq 90°$ for any sound frequency. The slope of mIPD, i.e., directional DS, approaches zero near the two extreme positions $\theta=\pm 90°$, where the sensor system has no differentiating ability. However, in the vicinity of midline $\theta=0°$, mIPD can be approximated as a linear function of $\theta$. The structural parameters of the fly ear are optimized to maximize the absolute slope and linearity of this linear function.

Derivation of the Linear Determination Data includes using experimental calibration to approximate mIPD by a linear function of $\theta$ as $mIPD=a\theta+b$ in the pre-defined linear range (e.g. $-30° \leqq \theta \leqq 30°$) at the working frequency $f_w$, where a is the directional sensitivity, b is the zero offset due to unsymmetrical mechanical structure, midline misalignment, or unbalanced delay in the data acquisition system. Then, the phase difference at the boundary of the linear range can be calculated ($mIPD_L=a\cdot -30°+b$ or ($mIPD_R=a\cdot 30°\pm b$), which determines the range of mIPD measurement to deem the sound source inside the linear range or not.

Execution of the second software module further includes setting the turning angle $\alpha$ is set to a constant value, e.g. 20° when it is determined that mIPD is outside the linear range and calculating the true azimuth $\theta$ of the sound source using the linear relationship between mIPD and azimuth $\theta$ when mIPD is determined to be in the linear range. The processor of signal interpreter device 130 further executes the second software module for calculating a turning angle $\alpha$ that can be used to rotate the directional sensor 102 so that it is oriented at the calculated true azimuth $\theta$.

Through experimental calibration, the mIPD data in the linear range can be curve fitted by a straight line $mIPD=a\theta+b$, where a is the directional sensitivity or slope of the linear curve, and b is the offset at zero azimuth. In sound source localization, if the measured phase difference is equal to mIPD, the angle to turn relative to the midline is calculated by $\theta=-(mIPD-b)/a$. The signal interpreter 130 transmits the turning angle $\alpha$ to the controller 1106 to control rotation of the sensor. This may be repeated until the calculated turning angle $\alpha$ is below a selected threshold.

The first and second software modules each include a series of programmable instructions can be stored on a computer-readable medium accessible by the processor 140, such as RAM, a hard drive, CD, smart card, 3.5" diskette, etc., for performing the functions disclosed herein and to achieve a technical effect in accordance with the disclosure. The modules may be combined or further divided into additional individual software modules.

Figure 12:
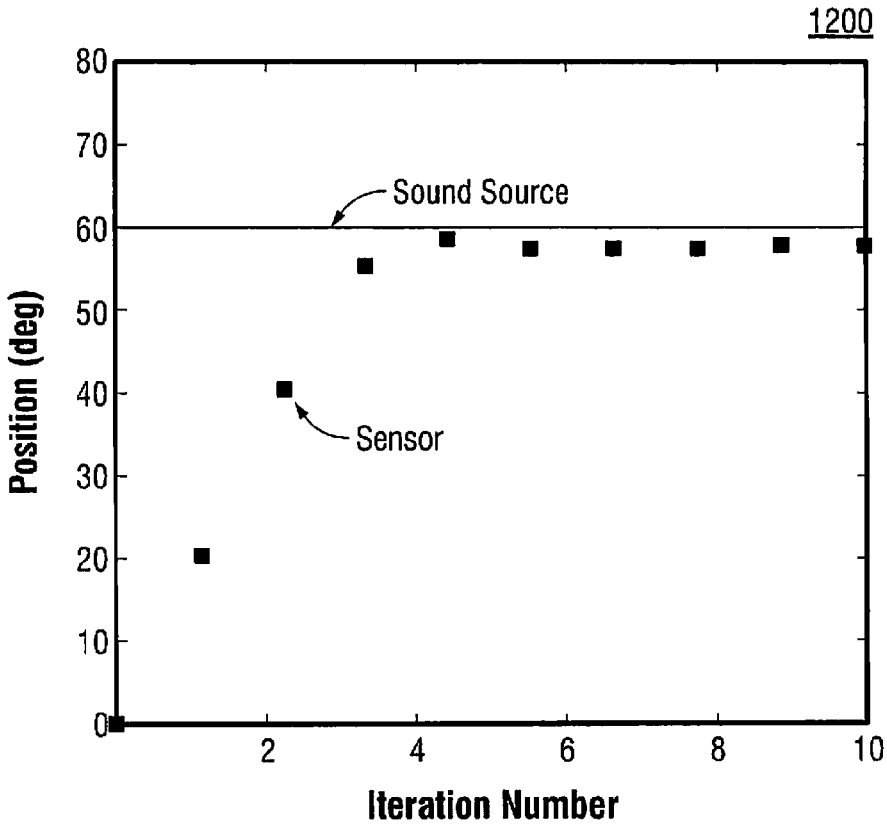
FIG. 12 shows experimental results of the tracking ability of the directional sensor when mounted on the motorized platform and rotated under the control of controller.

FIG. 12 shows experimental results of the tracking ability of the directional sensor 102 when mounted on the motorized platform 1102 and rotated under the control of controller 1106. As shown by plot 1200 of FIG. 12, the directional sensor 102 is able to pinpoint the sound source within a ±2° accuracy in just a few iterations.

Prototype Example

The prototype directional sensor 102 used for generating the experimental data shown in FIGS. 9-10 and FIG. 12 is fabricated using MEMs techniques. The directional sensor 102 includes membranes 104 formed of poly-Si having a thickness of 0.6 μm and a radius of 590 μm. Bridge 106 is formed of alternative layers of $SiO_2$ and $Si_3N_4$, having a length of 1.25 mm long, a width of 300 μm, and a thickness of 3.2 μm. The separation between two membrane centers is substantially the same as the distance between the fly eardrum centers. The substrate 108 and backplate 112 are formed of silicon. The gap between the tips 321 of optical fiber cables 320 and the membranes 104 is adjusted using an optical spectrum analyzer (OSA) to match with the FP tunable filters 326. The optical fiber cables 322 are permanently fixed to the fiber guider 140 by using ultraviolet-cured epoxy. Platform 1102 and motor 1104 are formed of a motorized rotational stage, and controller 1106 includes motion controller connected to a computer.

The vibration modes of the sensor are measured by a Laser Doppler Vibrometer (LDV) machine. The first two resonant frequencies are identified at $f_{rm}$=10.3 kHz and $f_{bm}$=30 kHz. To measure the directional cues, a single frequency sound is played through a speaker. Photo-detectors 328 output sinusoidal signals that the signal interpreter 130 compares for calculating directionality information, such as mIID, mIPD, and/or mITD.

Sensor Configurations

Figure 13:
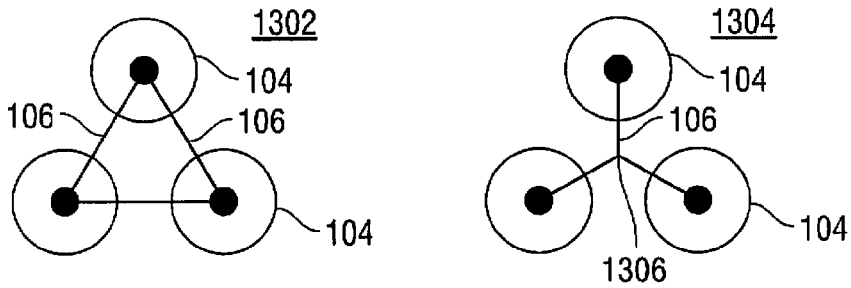
FIG. 13 is a schematic diagram showing first and second membrane configurations, each including three membranes.

The directional sensor 102 may include more than two membranes 104. FIG. 13 shows a first and second membrane configuration 1302 and 1304, respectively, for which designs and prototypes have been developed. In the first configuration 1302 three membranes 104 are provided, and each pair of membranes 104 is coupled by a bridge 106. Each bridge pivots or bends about its midline. In the second configuration 1304, three membranes 104 and a bridge 106 having three branches joined at a central point 1306 are provided, with each membrane 104 coupled to a distal end of a respective branch of the bridge 106. The branches of the bridge 106 pivot about the central point 1306. Other configurations are envisioned that include more than two membranes 104 and at least one bridge 106.

Each configuration may have different vibration modes which may be determined by modal analysis. Experimentation and modal analysis has revealed that configuration 1302 has two rocking modes and one bending mode. Directionality information provided by the three membrane configurations 1302 and 1304 can be used by signal interpreter device 130 to determine the incident angles of a sound source in two dimensions, including the azimuth $\theta$ and the elevation.

When the directional sensor 102 has membranes 104 fashioned in accordance with configuration 1302 or 1304, there are two rocking modes sharing the same $f_{rm}$, Similar to the configuration shown in FIG. 1, both frequencies $f_{rm}$ and $f_{bm}$ are determined by the stiffness of the bridge(s) 106 and the stiffness of the membranes 104. Two phase differences mIPD can be determined, which can be used to obtain the azimuth and elevation angles that describe the location of the source in two dimensions. The relationships between the two mIPD and the azimuth/elevation angles are coupled, as each obtained mIPD is a function of both the azimuth and elevation angles, so solving two equations describing these relationships is used to obtain the values of the two angles.

Figure 14:
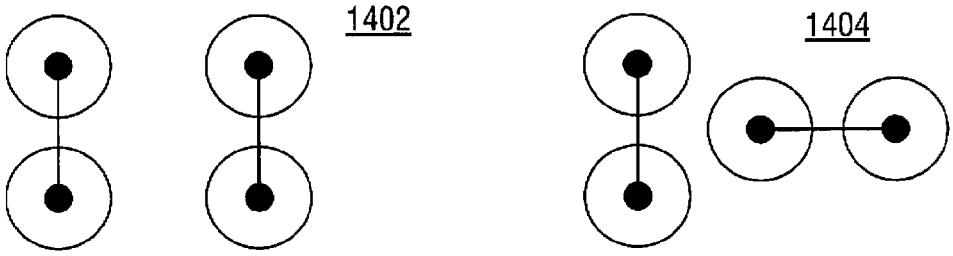
FIG. 14 is a schematic diagram showing first and second sensor arrays, wherein one array includes parallel bridges coupling membrane pairs, and the second array includes perpendicular bridges coupling member pairs.

FIG. 14 shows first and second sensor arrays 1402 and 1404, respectively. The first sensor array 1402 includes multiple directional sensors 102 having two membranes 104 each, and configured in an array on a single plane, with the bridges 106 aligned parallel to one another. Signal interpreter device 130 processes information from the sensor devices 102 included in configuration 1402, such as to improve the directionality information. Directionality information provided by the configurations 1402 can be used by the signal interpreter device 130 to statistically minimize estimation error and improve localization accuracy.

The second sensor array 1404 includes multiple directional sensors 102 having two membranes 104 each, and configured in an array on a single plane, with the bridge 106 of one of the directional sensors 102 perpendicular to the bridge 106 of an adjacent directional sensor 102. Directionality information provided by the configurations 1404 can be used by signal interpreter device 130 to localize a sound source in two dimensions, including the azimuth and elevation angles.

It will be appreciated that various of the above-disclosed and other features and functions, or alternatives thereof, may be desirably combined into many other different systems or applications. For example, directional sensors 102 having three or more membranes 104, such as the examples shown in FIG. 13, may be configured in an array, such as those shown in FIG. 14. Furthermore, the directional sensors 104 or arrays of directional sensors 104 may be arranged in more than one plane for providing three-dimensional information. Also that various presently unforeseen or unanticipated alternatives, modifications, variations or improvements therein may be subsequently made by those skilled in the art which are also intended to be encompassed by the following claims.

What is claimed is:

1. A sensor system comprising at least one directional sensor, each directional sensor comprising:

at least two compliant membranes for moving in reaction to an excitation acoustic signal; and at least one compliant bridge, each bridge coupled to at least a respective first and second membrane of the at least two membranes for moving in response to movement of the membranes it is coupled to for causing movement of the first membrane to be related to movement of the second membrane when either of the first and second membranes moves in response to excitation by the excitation signal, wherein each directional sensor is provided with a sensor for sensing vibrations of the at least two membranes and circuitry for comparing the sensed vibrations of the at least two membranes for determining directionality information about the location of a sound source of the excitation signal, and thereafter calculate an azimuth angle that describes the location of the sound source relative to a reference.

2. The sensor system according to claim 1, each directional sensor further comprising a substrate and defining at least two cavities, wherein:

each of the at least two membranes has opposing top and bottom surfaces;

each membrane of the at least two membranes covers a respective cavity of the at least two cavities with at least a portion of its bottom surface exposed to the cavity; and the membrane is coupled to the substrate for remaining positioned to cover the associated cavity when reacting to the excitation acoustic signal.

3. The sensor system according to claim 2, wherein each bridge of the at least one bridge is further coupled to the substrate at a pivot area positioned between the at least first and second membranes.

4. The sensor system according to claim 3, wherein the coupling of the bridge to the substrate allows the bridge to move by at least one of pivoting and bending about the pivot area.

5. The sensor system according to claim 1, wherein the acoustic excitation signal causes the at least two membranes of the directional sensor to move with respect to one another in vibration modes, wherein in an equivalent lumped mechanics model the vibration modes include at least a rocking vibration mode, in which two membranes of the at least two membranes move 180 degrees out of phase, and a bending vibration mode, in which two membranes of the at least two membranes move in phase.

6. The sensor system according to claim 5, wherein:

d is the distance between corresponding reference points of two membranes of the at least two membranes;

$\lambda_{ss}$ is the wavelength of the excitation acoustic signal; and wherein parameters d, $\lambda_{ss}$, $f_{rm}$ and $f_{bm}$ are related so that at least one parameter chosen from the group of parameters consisting of d, $\lambda_{ss}$, $f_{rm}$ and $f_{bm}$ is selected based on the other parameters of the group of parameters.

7. The sensor system according to claim 6, wherein the determined $f_{rm}$ and $f_{bm}$ are selected so that the vibrations of two membranes of the at least two membranes of the directional sensor include contributions from rocking mode and bending mode vibrations in a proportion for achieving maximal directional sensitivity DS and minimal nonlinearity NL approximately at a midline between the two membranes, wherein the midline is a line at the middle of the two membranes that is perpendicular to a line connecting centers of two membranes.

8. The sensor system according to claim 1, wherein the sensor further comprises an encoder which uses optical detection for measuring the displacement of the at least two membranes in response to the excitation acoustic signal.

9. The sensor system according to claim 8, wherein the encoder includes a Fabry-Perot (FP) cavity and an optical fiber tip disposed in the FP cavity and opposing a surface of a membrane of the at least two membranes for measuring a change of light propagation path.

10. The sensor system according to claim 9, further comprising a a low coherence fiber optical interferometer system which includes the encoder and uses light generated by a broadband light source and further includes a reference interferometer having an FP cavity with an adjustable length.

11. The sensor system according to claim 1, wherein each directional sensor is mounted on a rotatable platform and each rotatable platform is provided with:

means for rotating the platform;

at least one tangible processor; and at least one memory with instructions to be executed by the at least one tangible processor for:

accessing experimentally calibrated data that shows a relationship between the directionality information and a position of the sound source, including a range of values for the directionality information when it has a linear relationship with the location of the sound source;

comparing the directionality information with the experimentally calibrated data to determine if the sound source is in the linear range;

when the sound source is in the linear range, determining a turning angle based on the linear relationship between the directionality information and sound source position described in the experimentally calibrated data;

when the sound source is outside the linear range determining the turning angle by setting it to a constant value; and controlling the means for rotating the platform by turning it in accordance with the determined turning angle.

12. The sensor system according to claim 1, wherein the at least two directional sensors are arranged in an array and the sensor system includes processing means for processing directionality information associated with each directional sensor of the array for generating improved directionality information.

13. The sensor system according to claim 12, wherein the improved directionality information includes the location of the sound source in three-dimensional space.

14. The sensor system according to claim 1, wherein the at least two membranes include at least two membranes and the at least one bridge couples all of the at least two membranes so that when each membrane of the at least two membranes is excited, its movement is transmitted by the at least one bridge and affects movement of at least one other membrane of the at least two membranes.

15. The sensor system according to claim 14, wherein when the at least one bridge is excited it pivots about one pivot area.

16. The sensor system according to claim 14, wherein when the at least one bridge is excited it pivots about at least two pivot areas.

17. The sensor system according to claim 1, further comprising means for adjusting compliance of at least one of the at least two membranes and the at least one bridge for tuning the sensor system to operate optimally with the excitation acoustic signal having a selected frequency.

18. The sensor system according to claim 2, wherein a communication path is provided between at least one of:

two cavities of the at least two cavities for allowing communication of gas between the two cavities; and a cavity of the at least two cavities and the ambient environment for allowing for communication of gas between the ambient environment and the cavity.

19. A method for sensing sound and determining directionality information about a location of a sound source of the sound, the method comprising:

sensing an excitation acoustic signal by at least a first and second membrane which are sufficiently compliant to move in reaction to the excitation acoustic signal;

vibrating by the at least first and second membranes in response to the sensing;

coupling the vibrations while pivoting about a fixed pivot area for causing vibrations of the first membrane to be related to vibrations of the second membrane when at least one of the first and second membranes senses the excitation acoustic signal;

sensing the vibrations of the first and second membranes; and comparing the sensed vibrations of the first and second membranes for determining directionality information about the location of a sound source of the excitation acoustic signal, including an angle that describes the location of the sound source relative to a reference.

20. The method according to claim 19, further comprising:

rotating the first and second membranes;

controlling the rotating including:

accessing experimentally calibrated data that shows a relationship between the directionality information and a position of the sound source, including a range of values for the directionality information when it has a linear relationship with the location of the sound source;

comparing the directionality information with the experimentally calibrated data to determine if the sound source is in the linear range;

when the sound source is in the linear range, determining a turning angle based on the linear relationship between the directionality information and sound source position described in the experimentally calibrated data;

when the sound source is outside the linear range determining the turning angle by setting it to a constant value; and controlling the rotating by rotating in accordance with the determined turning angle.

21. A directional sensor comprising:

a substrate and defining at least two cavities;

first and second membranes, each having opposing top and bottom surfaces and coupled to the substrate to cover a respective cavity of the at least two cavities with at least a portion of its bottom surface exposed to the cavity, wherein the first and second membranes are sufficiently compliant for moving in reaction to an excitation signal, yet remain positioned to cover the associated cavity when reacting to the excitation signal; and a compliant bridge coupled to the substrate at a pivot area positioned between the at least first and second membranes and further coupled to the first and second membranes for moving in response to movement of either of the first and second membranes, including at least one of pivoting and bending about the pivot area, for causing movement of the first membrane to be related to movement of the second membrane when at least one of the first and second membranes moves in response to excitation by the excitation signal.

22. The directional sensor according to claim 21, each directional sensor further comprising a sensor for sensing vibrations of the first and second membranes and circuitry for comparing the sensed vibrations of the first and second membranes for determining directionality information about the location of a sound source of the excitation signal, including an angle that describes the location of the sound source relative to a reference.

23. A sensor system comprising at least one directional sensor, each directional sensor comprising:

at least two compliant membranes for moving in reaction to an excitation acoustic signal;

at least one compliant bridge, each bridge coupled to at least a respective first and second membrane of the at least two membranes for moving in response to movement of the membranes it is coupled to for causing movement of the first membrane to be related to movement of the second membrane when either of the first and second membranes moves in response to excitation by the excitation signal; and a substrate and defining at least two cavities, wherein:

each of the at least two membranes has opposing top and bottom surfaces;

each membrane of the at least two membranes covers a respective cavity of the at least two cavities with at least a portion of its bottom surface exposed to the cavity; and the membrane is coupled to the substrate for remaining positioned to cover the associated cavity when reacting to the excitation acoustic signal.

24. A sensor system comprising at least one directional sensor, each directional sensor comprising:

at least two compliant membranes for moving in reaction to an excitation acoustic signal; and at least one compliant bridge, each bridge coupled to at least a respective first and second membrane of the at least two membranes for moving in response to movement of the membranes it is coupled to for causing movement of the first membrane to be related to movement of the second membrane when either of the first and second membranes moves in response to excitation by the excitation signal;

wherein the acoustic excitation signal causes the at least two membranes of the directional sensor to move with respect to one another in vibration modes, wherein in an equivalent lumped mechanics model the vibration modes include at least a rocking vibration mode, in which two membranes of the at least two membranes move 180 degrees out of phase, and a bending vibration mode, in which two membranes of the at least two membranes move in phase.

25. The sensor system according to claim 24, wherein the at least two membranes include at least two membranes and the at least one bridge couples all of the at least two membranes so that when each membrane of the at least two membranes is excited, its movement is transmitted by the at least one bridge and affects movement of at least one other membrane of the at least two membranes.

26. The sensor system according to claim 24, wherein when the at least one bridge is excited it pivots about one pivot area.

27. The sensor system according to claim 24, wherein when the at least one bridge is excited it pivots about at least two pivot areas.

28. The sensor system according to claim 24, further comprising means for adjusting compliance of at least one of the at least two membranes and the at least one bridge for tuning the sensor system to operate optimally with the excitation acoustic signal having a selected frequency.

* * * * *